US005718202A

United States Patent [19]

Bentz et al.

[11] Patent Number: 5,718,202

[45] Date of Patent: Feb. 17, 1998

[54] APPARATUS FOR AN INTERNAL COMBUSTION ENGINE

[75] Inventors: Willy Bentz, Sachsenheim; Waldemar Ernst, Vaihingen; Peter Schiefer, Untergruppenbach, all of Germany; Heiko Buss, El Paso, Tex.

[73] Assignee: Robert Bosch GmbH, Stuttgart, Germany

[21] Appl. No.: 693,192

[22] PCT Filed: Nov. 7, 1995

[86] PCT No.: PCT/DE95/01534

§ 371 Date: Aug. 23, 1996

§ 102(e) Date: Aug. 23, 1996

[87] PCT Pub. No.: WO96/18028

PCT Pub. Date: Jun. 13, 1996

[30] Foreign Application Priority Data

Dec. 7, 1994 [DE] Germany ..... 44 43 502.9

[51] Int. Cl.[6] ..... F02D 9/10; F02D 11/10

[52] U.S. Cl. ..... 123/399; 123/337

[58] Field of Search ..... 123/399, 361, 123/520, 494, 337, 478; 73/118.2

[56] References Cited

U.S. PATENT DOCUMENTS 4,766,869 8/1988 De Concini et al. ..... 123/478

4,926,821 5/1990 Porth et al. ..... 123/399

4,991,560 2/1991 Arai et al. ..... 123/494

4,995,369 2/1991 Cook ..... 123/520

*Primary Examiner*—Willis R. Wolfe

*Assistant Examiner*—Hieu T. Vo

*Attorney, Agent, or Firm*—Edwin E. Greigg; Ronald E. Greigg

[57] ABSTRACT

Electronic engine management systems have a plurality of individual components, some of which are relatively far away from one another. Electrically connecting the individual components, particularly to an electronic control unit therefore requires relatively long electrical connecting lines and relatively many plug connection. The apparatus includes a plurality of components, that is, at least one throttle device accommodated rotatably in a throttle valve housing and actuatable by a throttle valve control motor, an electronic control unit, a regenerating valve, and/or an air flow rate meter, which according to the invention are accommodated in a common housing as a premountable structural unit. The apparatus of the invention is intended in particular for mixture-compressing internal combustion engines with externally supplied ignition.

15 Claims, 4 Drawing Sheets

APPARATUS FOR AN INTERNAL COMBUSTION ENGINE

STATE OF THE ART

The invention is based on an electronic control apparatus for an internal combustion engine. An apparatus is already known (European Patent EP 0 317 813) that has a throttle device in the form of a throttle valve that is rotatably accommodated in a throttle valve housing. For adjusting the throttle valve, an electric throttle valve control motor is provided, which rotates the throttle valve via a step-down gear. Such electric-motor-driven apparatuses are part of an electronic engine management system (EMS) for internal combustion engines, in which an electronic control unit evaluates the position of an accelerator pedal, detected by a pedal travel sensor, in order to trigger the electric throttle valve control motor in accordance with the pedal position so that the throttle valve assumes a predetermined rotary position. The electronic engine management system (EMS) is capable of purposefully varying the rotary position of the throttle valve as a function of various engine operating parameters. This makes it possible, among other effects, to adapt the engine torque in a meterable way, so that it is also possible to perform so-called traction control (ASR). In the traction control (ASR), the driver demand, expressed by the position of the accelerator pedal, is corrected so that in starting, spinning of the engine-driven wheels of a motor vehicle is prevented by purposefully pulling back the rotary position of the throttle valve.

The electronic engine management system (EMS) is part of an overall electronic engine control system, which besides its main functions of mixture forming and electric ignition also controls the introduction of fuel vapors into the throttle valve housing by means of a regenerating valve. The regenerating valve is part of a fuel vapor trapping system of a fuel tank of the engine, in which the fuel vapors of a fuel tank are for instance initially stored temporarily in an adsorption filter and then introduced into the throttle valve housing by means of the regenerating valve.

The engine control system requires a great deal of information about important engine operating variables, which are furnished by sensors and delivered to the electronic control unit for evaluation. One important sensor is known as an air flow rate meter, which determines the mass of air in the throttle valve housing aspirated by the engine. The engine control system has a plurality of individual components, which essentially include the electronic control unit, the throttle device, the throttle valve control motor, the regenerating valve, and the air flow rate meter. Until now, these individual components have been accommodated individually in separate housings, for example on the engine in the engine compartment, or in the passenger compartment of the motor vehicle, so that many electrical connection lines and plug connections are needed to connect the individual components, especially to the electronic control unit.

ADVANTAGES OF THE INVENTION

The apparatus of the invention for an internal combustion engine has the advantage over the prior art that a compact component is created that can be manufactured economically and that in particular, as a prefabricated and pretested component, is simple to mount on the motor vehicle. Because of the elimination of otherwise usual single housings and their electrical connecting lines and electrical plug connections, further cost savings are advantageously achieved. Moreover, the operating safety and reliability of the apparatus is increased because of the reduced number of electrical connecting lines and electrical plug connections.

Advantageous further features of and improvements to the apparatus are possible as a result of the provisions recited hereinafter.

BRIEF DESCRIPTION OF THE DRAWINGS

Exemplary embodiments of the invention are shown in simplified form in the drawing and described in further detail below.

DETAILED DESCRIPTION OF THE EXEMPLARY EMBODIMENTS

Figure 1:
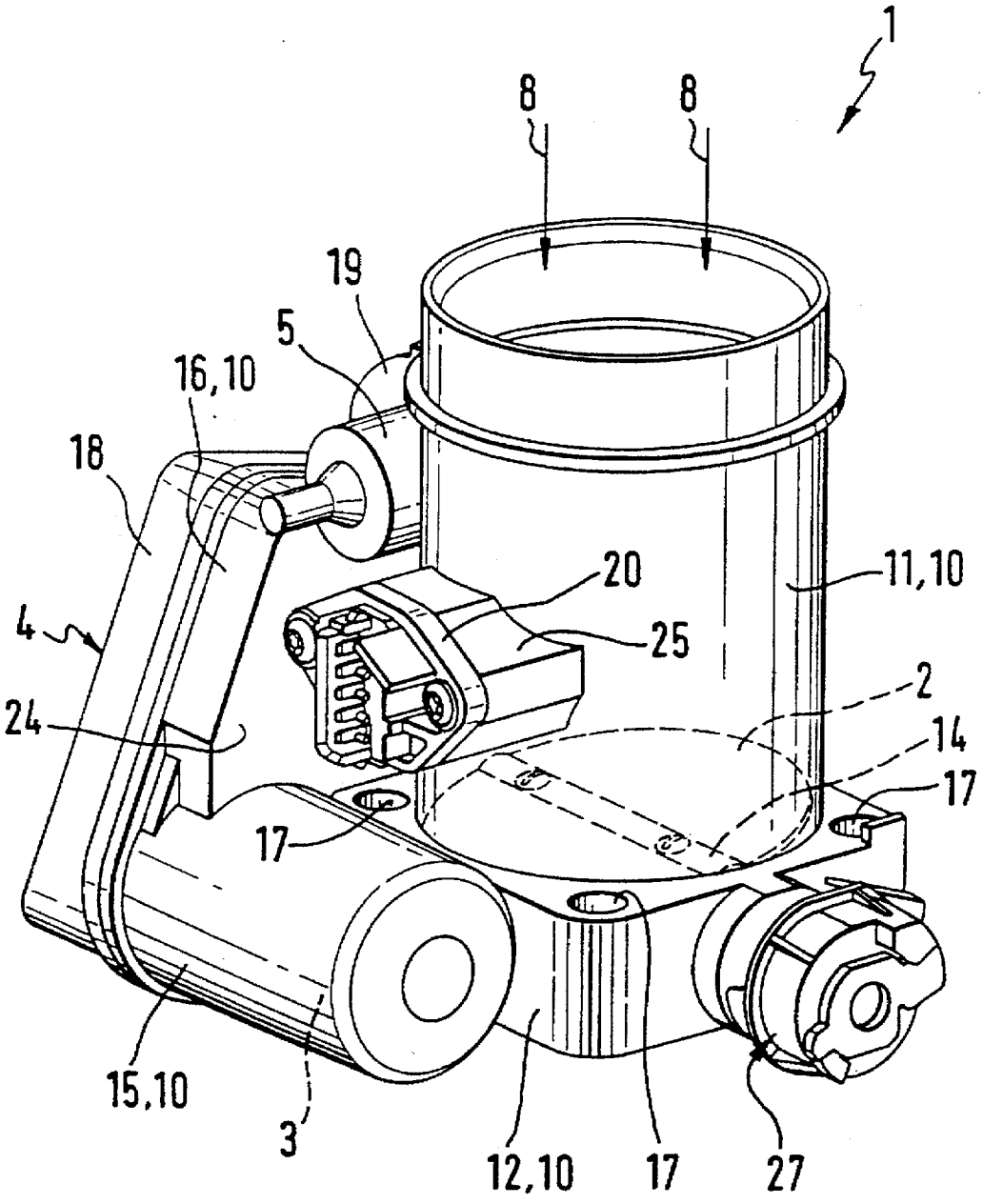
FIG. 1 is a perspective view of an apparatus in accordance with a first exemplary embodiment of the invention.

FIGS. 1–4 show an apparatus generally identified by reference numeral 1, which as a functional unit is part of an electronic engine management system (EMS) of an overall engine control system for an internal combustion engine, not otherwise shown. The apparatus is intended in particular for use for mixture-compressing engines with externally supplied ignition. The apparatus 1 substantially includes a throttle device 2, an electric throttle valve control motor 3, an electronic control unit 4, a regenerating valve 5, and/or an air flow rate meter 20. The regenerating valve 5 is part of a fuel vapor trapping system of a fuel tank of the engine, whose design and function are of the kind that can be learned for instance from Bosch Technische Unterrichtung, Motormanagement Motronic [Bosch Technical Instruction, Motronic Engine Management System], Second Edition, August 1993, pp. 48 and 49. The disclosure content of the this publication is hereby incorporated by reference into the present application.

The apparatus 1 has a housing 10, which is made of plastic or aluminum, for instance made by casting, for example. The apparatus 1 or housing 10 has a tubular elongated shape essentially formed by a throttle valve housing 11. The throttle valve housing 11, on an end region oriented toward the engine, has a flange portion 12 for instance of blocklike shape. The throttle device 2 is rotatably accommodated in the throttle valve housing 11, in particular in the flange part 12, and takes the shape for instance of a throttle valve 2 as indicated by the dashed lines in FIGS. 1–4. A gaseous medium, in particular the air aspirated by the engine, flows in the interior of the throttle valve housing 11, for instance flowing from top to bottom into the throtlle valve housing 11 of FIGS. 1–4 via an air filter, not shown in further detail. The flow direction is indicated by arrows 8 in FIGS. 1–4. The flange part 12 also serves to secure the apparatus 1, for instance in the region of a cylinder head of the engine. To that end, openings 17, four of them for instance, are made in the flange part 12, and screws for screw-mounting the apparatus 1 can be accommodated in them.

The performance of the engine is controlled in the known manner by rotation of the throttle valve 2 in the throttle valve housing 11, causing more or less air to flow past the throttle valve 2. By means of at least one fuel injection valve, fuel is admixed with the throttled air, in order to obtain a fuel-air mixture that then burns in combustion chambers of the engine. For rotating the throttle valve 2, the electric throttle valve control motor 3 is provided, which via a step-down gear, for instance, when current is supplied to it, drives a throttle valve shaft 14 connected to the throttle valve 2. The triggering of the throttle valve control motor 3 is effected by means of the electronic control unit 4, which is connected for example to a pedal travel sensor. The pedal travel sensor ascertains the engine performance demanded by the driver, as expressed by the position of an accelerator pedal, and transmits it to the electronic control unit 4 in the form of electrical signals.

The electronic control unit 4 thereupon actuates the electric throttle valve control motor 3, so that the throttle valve 2 will assume a predetermined rotary position that meets the driver demand and is adapted to the operating variables of the engine. A restoring device 27 facing the throttle valve control motor 3 on the flange part 12 and engaging the throttle valve shaft 14 assures that if the throttle valve control motor 3 fails, restoration of the throttle valve 2, for instance to a predetermined idling or blocking position, will always take place. In addition to the electronic engine management system (EMS) by means of the throttle valve control motor 3 as described, the electronic control unit 4 also takes on extensive functions of an overall electronic engine controller. The electronic engine controller controls not only the main functions of mixture formation and electric ignition but among others also the quantitatively and chronologically limited introduction of fuel vapors by means of the regenerating valve 5. The regenerating valve 5 is part of a fuel vapor trapping system of a fuel tank of the engine, which for instance has an adsorption filter for temporary storage of the outgassing fuel vapors in the fuel tank, so as to introduce them into the throttle valve housing 11 via the regenerating valve 5 only in certain engine operating ranges. The electronic control unit 4 of the engine control system requires a great deal of information about important engine operating variables, which are furnished by sensors and delivered to the electronic control unit 4 for evaluation. One important sensor is the air flow rate meter 20, which in the throttle valve housing 11 determines the mass of air aspirated by the engine.

Figure 2:
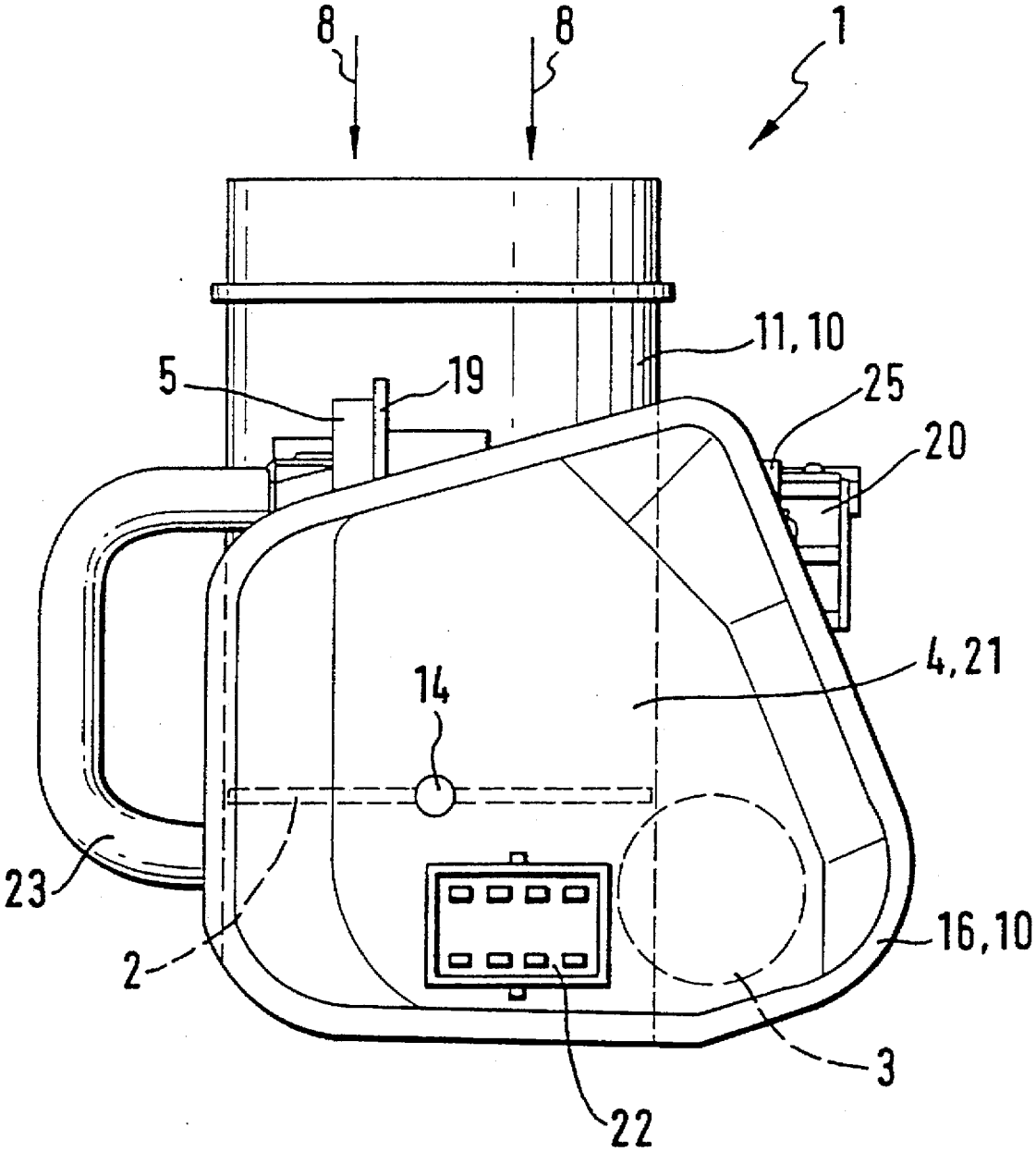
FIG. 2 is a side view of the apparatus of FIG. 1.

As shown in FIG. 1, the electric throttle valve control motor 3 has an elongated, cylindrical shape. The throttle valve control motor 3 is accommodated in a suitably cylindrically embodied crankcase 15, which is part of the housing 10 of the apparatus 1. The crankcase 15 extends along the flange part 12 crosswise to the throttle valve housing 11 and merges integrally with a boxlike housing part 16 of the housing 10. As shown in FIG. 2, which is a side view of the apparatus 1, the boxlike housing part 16 shelters a plurality of components, which include at least the electronic control unit 4, the throttle valve control motor 3, and a multi-pin plug connector 22. The primary component of the electronic control unit 4 is a substrate 21, on which many electrical components are mounted, for instance in hybrid fashion. For electrical contact purposes and for supplying current to the control unit 4, one or more plugs can be mounted on the plug connector 22. The substrate 21 is accommodated in the boxlike housing part 16 in the spatial vicinity of the throttle valve housing 11, so that being in good thermal contact it can carry the heat, produced in operation of the control unit 4, away from the air flowing in the throttle valve housing 11. As shown in FIG. 1, the boxlike housing part 16 can be tightly closed by a closure cap 18 that can be mounted on it, so that no water, dirt or the like can get into the boxlike housing part 16. The closure cap 18 has a recess for the plug connector 22, which is mounted for instance on the substrate 21 and which can protrude somewhat from the closure cap 18 once the closure cap 18 is in place, for instance. For the sake of simplicity, the closure cap 18 is not shown in FIGS. 2 and 4. It is also possible to mount the plug connector 22 on the closure cap 18 or to incorporate it into it, and to provide a flexible, multi-strand cable ribbon, for instance, for electrically connecting the plug connector 22 to the substrate 21. To establish an electrical connection with electrical components provided on the substrate 21, the cable ribbon is electrically connected on one end, on a side of the closure cap 18 toward the substrate 21, to the plug connector 22; on its other end it extends to the electrical components of the substrate 21.

As shown in FIGS. 1 and 2, the regenerating valve 5 is secured to the throttle valve housing 11, for instance by means of a retaining bracket 19 mounted on the throttle valve housing 11. The regenerating valve 5 is connected, via a hose not shown in further detail, for instance to the adsorption filter of the fuel vapor trapping system of the fuel tank of the engine. Via a hose 23 visible in FIG. 2, the regenerating valve 5 carries the fuel vapors from the fuel tank in a metered manner to the throttle valve housing 11, preferably downstream of the throttle valve 2. The regenerating valve 5 is embodied as actuatable electromagnetically and has a design that can be learned for instance from German Patent Disclosure DE-OS 40 23 044, U.S. Pat. No. 5,178,116, and which will therefore not be described in further detail below. The regenerating valve 5 can be triggered by the electronic control unit 4, to which end it is connected to the electronic control unit 4 electrically via an electric plug, not shown in detail, for instance via the plug connector 22.

In addition to or optionally instead of the regenerating valve 5, the apparatus 1 may be equipped with the air flow rate meter 20. The air flow rate meter has a design that can be learned for example from German Patent Disclosure DE-OS 38 44 354, U.S. Pat. No. 4,976,145, and has an elongated shape. The air flow rate meter 20 is inserted, for instance by being plugged in, into a formed-on feature 25 on the throttle valve housing 11, approximately in the middle of the elongated length of the throttle valve 11 and protrudes with its measurement portion 26, shown in FIG. 3, approximately to the middle of the flow cross section defined by the throttle valve housing 11, so as to determine the mass of air flowing through the flow cross section. Via an electrical connecting line, not shown, the air flow rate meter 20 is connected to the electronic control unit 4, for instance via the plug connector By accommodating a plurality of components in or on a common housing 10, in particular of the throttle device 2, the electronic control unit 4 and the regenerating valve 5 as well as the air flow rate meter 20, in accordance with the invention, a compact structural unit is created that advantageously integrates the functions of a plurality of individual components in one common unit. The apparatus 1 can be manufactured and tested in completely preassembled form, so that when mounted on the engine, only the screw connection on the cylinder head, for instance, needs to be mounted. By combining a plurality of components, many otherwise usual plug connections and electrical connecting lines, especially for connection with the electronic control unit 4, are omitted, resulting in a high degree of operating safety and reliability of the apparatus 1.

Figure 3:
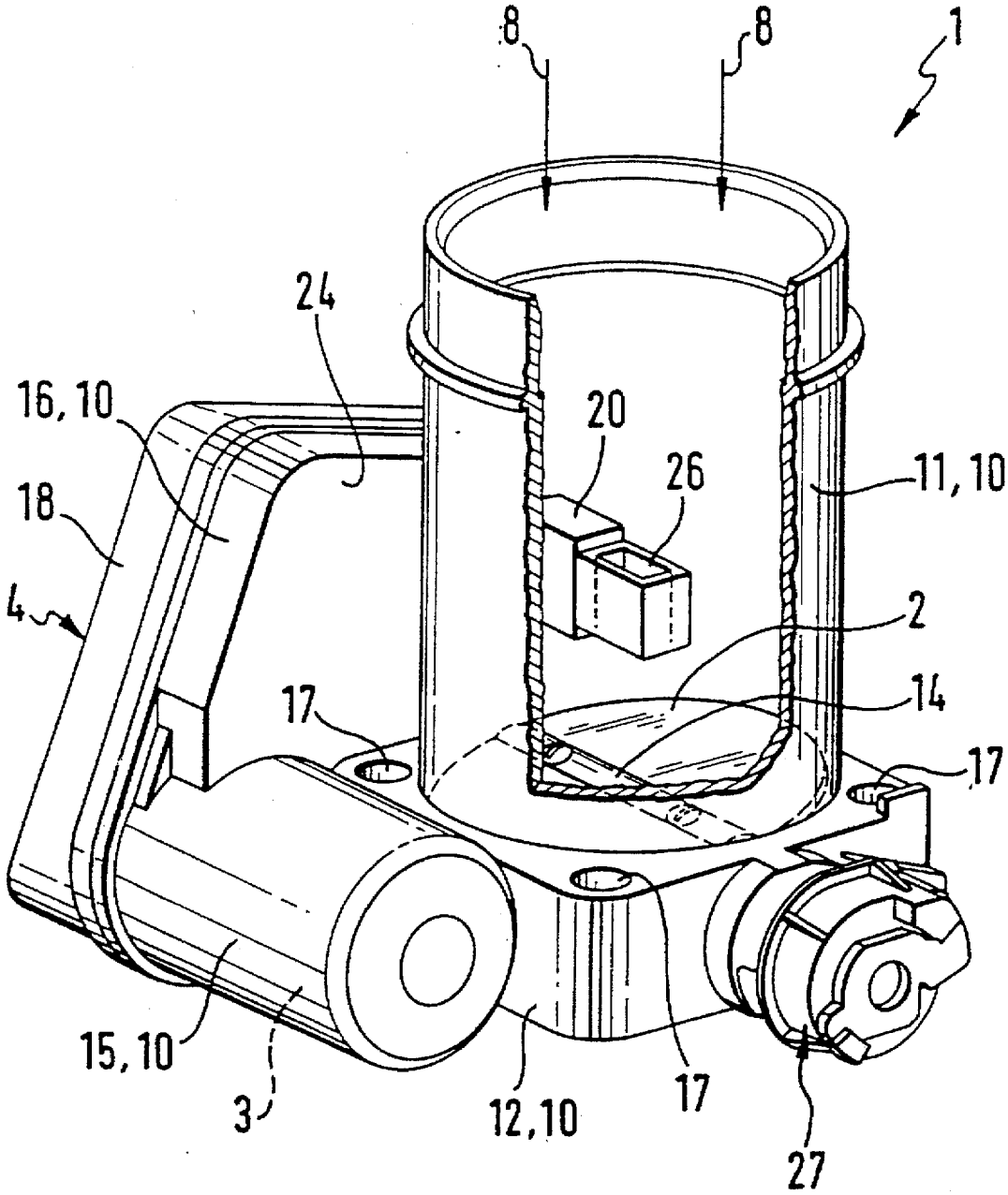
FIG. 3 is a perspective view of an apparatus in accordance with a second exemplary embodiment of the invention.
Figure 4:
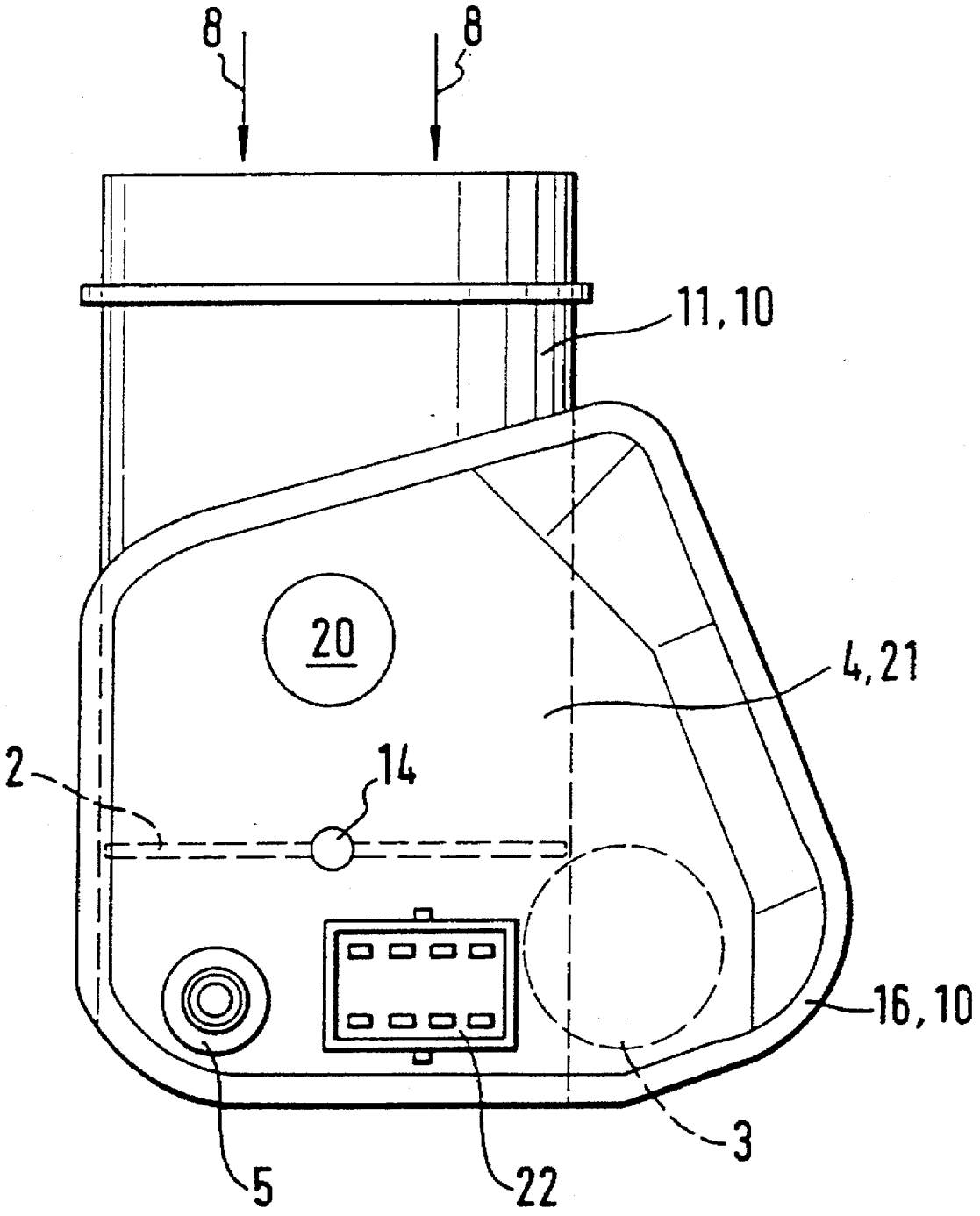
FIG. 4 is a side view of the apparatus of FIG. 3.

FIGS. 3 and 4 show a second exemplary embodiment of the invention, in which all the elements that are the same or function the same are identified by the same reference numerals as in the first exemplary embodiment of FIGS. 1 and 2. Compared with the first exemplary embodiment, the regenerating valve 5 is not secured to the throttle valve housing 11 by means of a retaining bracket 19 but instead is accommodated in the boxlike housing part 16, on the bottom 24 thereof, for instance by means of a clip or detent connection. The accommodation of the regenerating valve 5 is provided in the boxlike housing part 16 in such a way that via an opening in the bottom 24, direct feeding of the fuel vapors into the throttle valve housing 11 takes place downstream of the throttle valve 2; advantageously, the hose connection 23 shown in the first exemplary embodiment in FIG. 2 can then be omitted.

As shown in FIG. 4, the air flow rate meter 20 is likewise accommodated in the boxlike housing part 16. Part of the air flow rate meter body protrudes through an opening in the bottom 24 of the boxlike housing part 16 into the flow cross section of the throttle valve housing 11. The air flow rate meter 20, shown in simplified form as a circle in FIG. 4, protrudes with its measuring part 26, as in the first exemplary embodiment of FIG. 1, to approximately the middle of the flow cross section defined by the throttle valve housing 11. Accommodating the regenerating valve 5 and the air flow rate meter 20 together in the boxlike housing part 16 enables an especially simple layout of the electrical connecting paths, especially to the electronic control unit 4. The electrical connection can for instance be made by conductor tracks mounted on the substrate 21, which by soldering, for instance, electrically connect the regenerating valve 5 and the air flow rate meter 20 to the electronic components on the substrate 21 via the tracks, so that plugs and electrical connecting lines that are otherwise usual can be omitted.

The foregoing relates to preferred exemplary embodiments of the invention, it being understood that other variants and embodiments thereof are possible within the spirit and scope of the invention, the latter being defined by the appended claims.

What is claimed and desired to be secured by United States letters patent is:

1. An apparatus for an internal combustion engine, which comprises a common housing (10) as a premountable structural unit, said common housing including at least one throttle device, accommodated in a throttle valve portion of said common housing and actuatable by an electric throttle valve control motor, an electronic control unit in said common housing, the apparatus (1) includes a regenerating valve (5), and a fastening region flange (12) which serves to mount and retain the apparatus in a region of a cylinder head of an engine.

2. An apparatus in accordance with claim 1, in which the apparatus (1) includes an air flow rate meter (20).

3. An apparatus in accordance with claim 2, in which the air flow rate meter (20) is mounted in plugin fashion on the throttle valve portion of the common housing (10).

4. An apparatus in accordance with claim 2, in which the air flow rate meter (20) is accommodated in a boxlike portion (16) of the common housing (10).

5. An apparatus in accordance with claim 2, in which the regenerating valve (5) is accommodated in a boxlike portion (16) of the common housing (10).

6. An apparatus in accordance with claim 5, in which the regenerating valve (5) is accommodated in the boxlike portion (16) of the common housing (10) in such a way that the regenerating valve (5) communicates with a flow cross section downstream of the throttle device (2).

7. An apparatus in accordance with claim 2, in which the regenerating valve (5) is attached to the throttle valve housing (11) of the housing (10) by means of a retaining bracket (19).

8. An apparatus in accordance with claim 1, in which the electronic control unit (4) is accommodated in a boxlike portion (16) of the common housing (10).

9. An apparatus in accordance with claim 1, in which the regenerating valve (5) is accommodated in a boxlike portion (16) of the housing (10).

10. An apparatus in accordance with claim 9, in which the regenerating valve (5) is accommodated in the boxlike portion (16) of the common housing (10) in such a way that the regenerating valve (5) communicates with a flow cross section downstream of the throttle device (2).

11. An apparatus in accordance with claim 1, in which the regenerating valve (5) is attached to the throttle valve housing (11) of the housing (10) by means of a retaining bracket (19).

12. An apparatus for an internal combustion engine, which comprises a common housing (10) as a premountable structural unit, said common housing including at least one throttle device, accommodated in a throttle valve housing and actuatable by an electric throttle valve control motor, and an electronic control unit in said common housing, the apparatus (1) includes an air flow rate meter (20) and a fastening region flange (12) which serves to mount and return the apparatus in a region of a cylinder head of an engine.

13. An apparatus in accordance with claim 12, in which the air flow rate meter (20) is mounted in plugin fashion on the throttle valve portion of the common housing (10).

14. An apparatus in accordance with claim 12, in which the air flow rate meter (20) is accommodated in a boxlike portion (16) of the common housing (10).

15. An apparatus in accordance with claim 12, in which the electronic control unit (4) is accommodated in a boxlike portion (16) of the housing (10).

* * * * *